US009709322B2

(12) United States Patent
Jenkinson et al.

(10) Patent No.: US 9,709,322 B2
(45) Date of Patent: Jul. 18, 2017

(54) REFRIGERATOR WORK SURFACE

(71) Applicant: Electrolux Home Products, Inc., Charlotte, NC (US)

(72) Inventors: Peter Jenkinson, Anderson, SC (US); Jeremy Bowyer, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 14/871,906

(22) Filed: Sep. 30, 2015

(65) Prior Publication Data

US 2016/0290705 A1 Oct. 6, 2016

Related U.S. Application Data

(60) Provisional application No. 62/140,582, filed on Mar. 31, 2015.

(51) Int. Cl.
*F25D 25/02* (2006.01)

(52) U.S. Cl.
CPC ..... *F25D 25/02* (2013.01); *F25D 2323/021* (2013.01); *F25D 2400/04* (2013.01); *F25D 2400/08* (2013.01)

(58) Field of Classification Search
CPC ..... F25D 25/02; F25D 25/024
USPC ..... 312/401, 408, 402, 410, 281; 62/382
See application file for complete search history.

(56) References Cited

U.S. PATENT DOCUMENTS 562,727 A * 6/1896 Hooper ..... A47B 41/00 108/31
3,075,366 A * 1/1963 Jung ..... F25D 17/065 62/285
4,120,549 A * 10/1978 Bureau ..... B25H 3/00 280/47.35
4,436,356 A * 3/1984 Stelling ..... H05B 6/6402 108/93
5,497,878 A * 3/1996 Sandonato ..... B25H 1/04 206/372
2,692,813 A 9/1998 Toronto
5,810,462 A 9/1998 Lee
6,019,447 A * 2/2000 Jackovin ..... A47B 67/04 312/401
6,055,823 A 5/2000 Baker et al.
8,641,158 B1 2/2014 Connor, Sr.
(Continued)

FOREIGN PATENT DOCUMENTS

KR 20130094042 8/2013
WO WO 2007/115867 * 10/2007

*Primary Examiner* — James O Hansen
(74) *Attorney, Agent, or Firm* — Pearne & Gordon, LLP

(57) ABSTRACT

A refrigeration appliance includes an appliance housing. A liner within the appliance housing provides an upper interior storage chamber and a lower interior storage chamber. The upper interior storage chamber and the lower interior storage chamber are separated by a mullion. An upper movable closure is movable between an open position providing access to the lower interior storage chamber, and a closed position closing the upper interior storage chamber. A lower movable closure is movable between an open position providing access to the lower interior storage chamber, and a closed position closing the lower interior storage chamber. The mullion forms a storage pocket, and the refrigeration appliance further includes a deployable shelf configured to be withdrawn from the storage pocket in the mullion.

16 Claims, 6 Drawing Sheets

(56) References Cited

U.S. PATENT DOCUMENTS

| | | | | |
|---|---|---|---|---|
| 8,677,778 | B2 * | 3/2014 | Jeon | F25D 23/02 62/389 |
| 2005/0206287 | A1 | 9/2005 | House | |
| 2010/0320890 | A1 * | 12/2010 | Jung | F25D 27/00 312/402 |
| 2012/0060544 | A1 | 3/2012 | Lee et al. | |
| 2013/0147337 | A1 | 6/2013 | Lim | |

* cited by examiner

REFRIGERATOR WORK SURFACE

CROSS-REFERENCE TO RELATED APPLICATIONS

Benefit of U.S. Provisional Patent Application Ser. No. 62/140,582, filed Mar. 31, 2015, is hereby claimed and the disclosure incorporated herein by reference.

BACKGROUND OF THE INVENTION

Field of the Invention

The present invention relates to shelves for domestic appliances, such as refrigerators.

Description of Related Art

Domestic refrigerators typically have a plurality of shelves for supporting stored food items. Some refrigerators have movable shelves that can be withdrawn from a food storage chamber when the refrigerator is open.

BRIEF SUMMARY OF THE INVENTION

In accordance with one aspect of the present disclosure, provided is a refrigeration appliance. The refrigeration appliance includes an appliance housing. A liner within the appliance housing provides an upper interior storage chamber and a lower interior storage chamber. The upper interior storage chamber and the lower interior storage chamber are separated by a mullion. An upper movable closure is movable between an open position providing access to the upper interior storage chamber, and a closed position closing the upper interior storage chamber. A lower movable closure is movable between an open position providing access to the lower interior storage chamber, and a closed position closing the lower interior storage chamber. The mullion forms a storage pocket, and the refrigeration appliance further includes a deployable shelf configured to be withdrawn from the storage pocket in the mullion.

In accordance with another aspect of the present disclosure, provided is a refrigeration appliance. The refrigeration appliance includes an appliance housing. A liner within the appliance housing provides an upper fresh food storage chamber and a lower freezer storage chamber. The fresh food storage chamber and the freezer storage chamber are separated by a mullion. An upper door is movable between an open position providing access to the fresh food storage chamber, and a closed position closing the fresh food storage chamber. A lower drawer is movable between an open position providing access to the freezer storage chamber, and a closed position closing the freezer storage chamber. The mullion forms a storage pocket between the upper door and the lower drawer. The refrigeration appliance includes a deployable shelf configured to be withdrawn from the storage pocket in the mullion while the upper door and the lower drawer are in their respective closed positions.

DETAILED DESCRIPTION OF THE INVENTION

Figure 1:
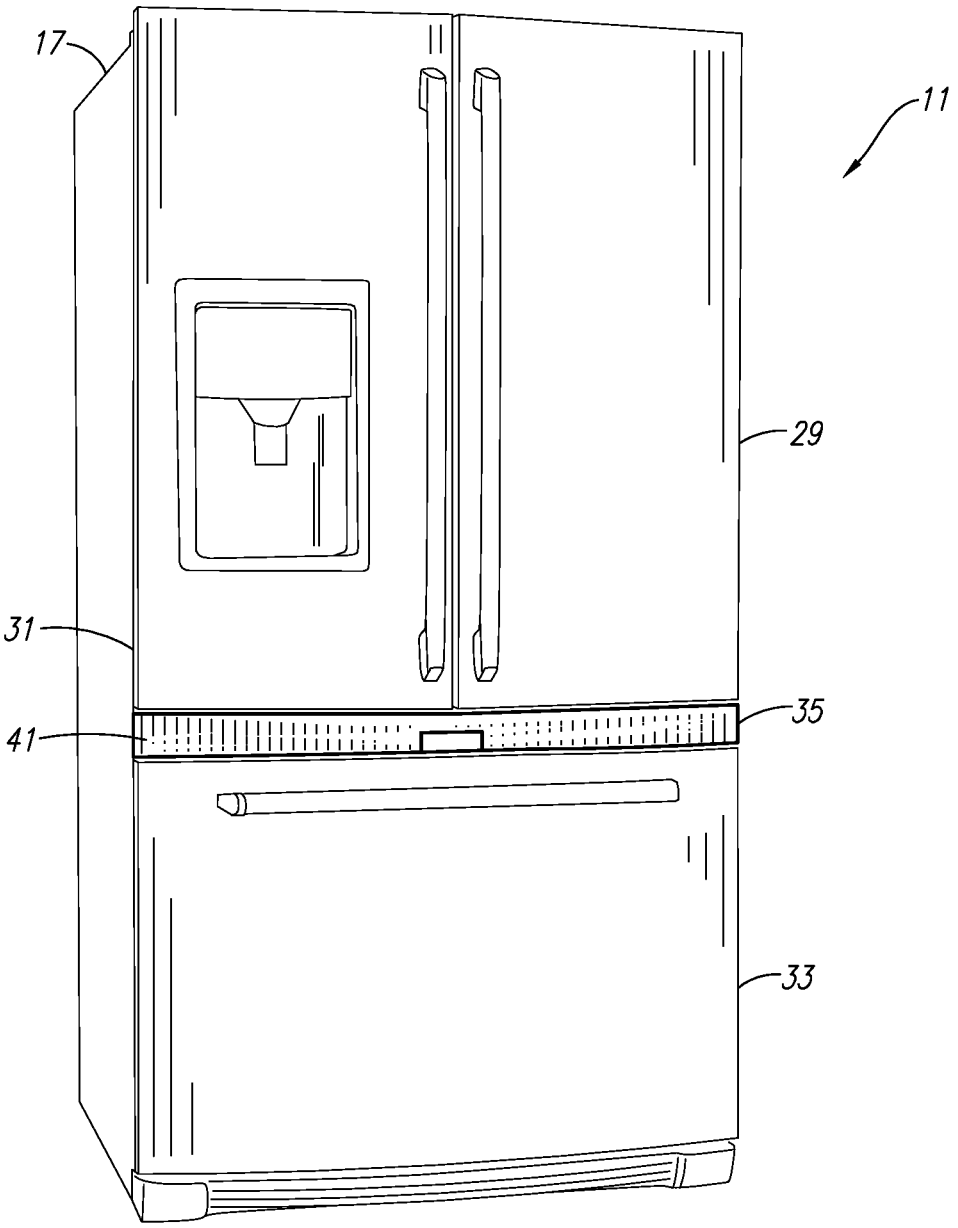
FIG. 1 is a perspective view of a refrigeration appliance.
Figure 2:
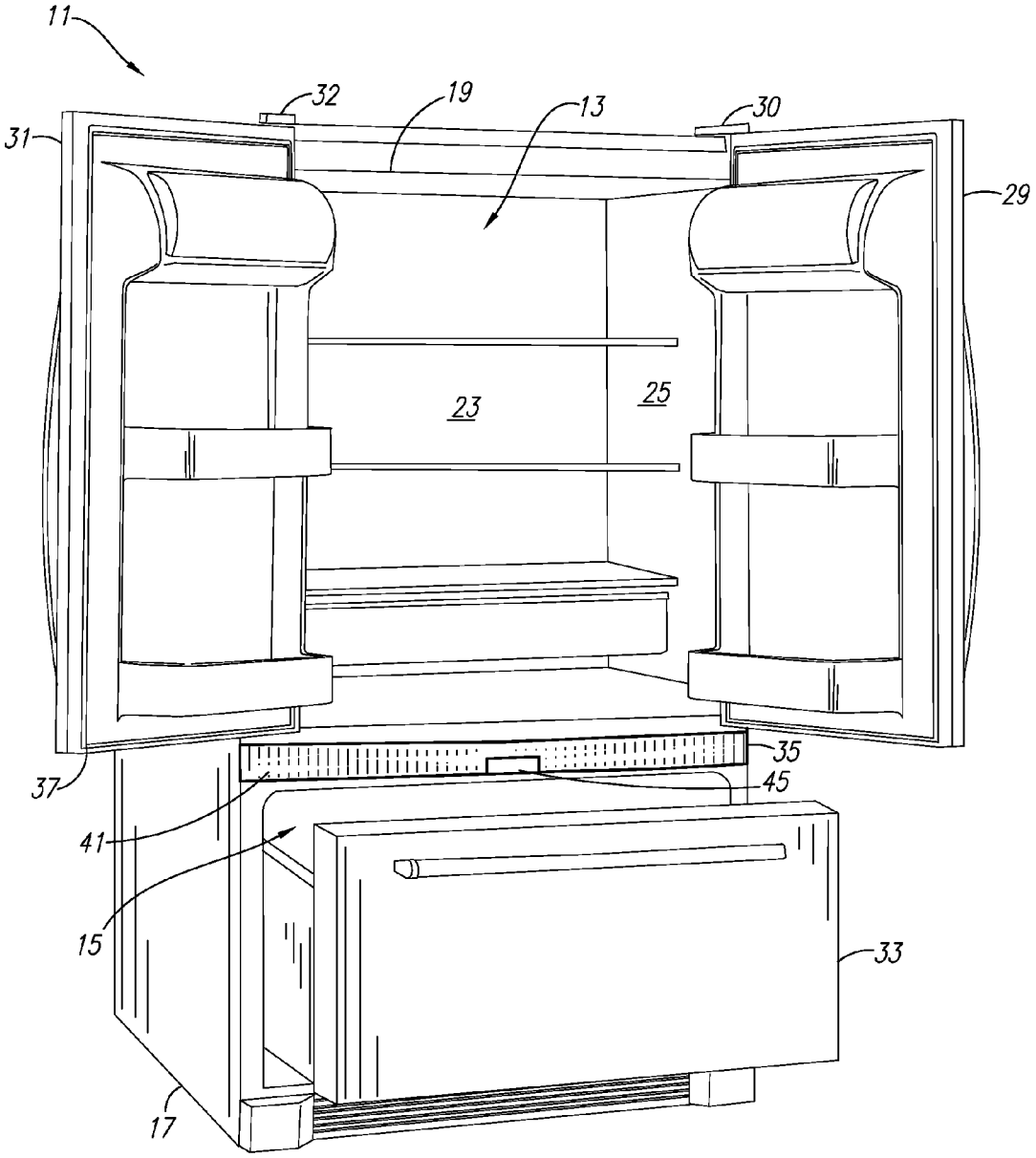
FIG. 2 is a perspective view of a refrigeration appliance.
Figure 3:
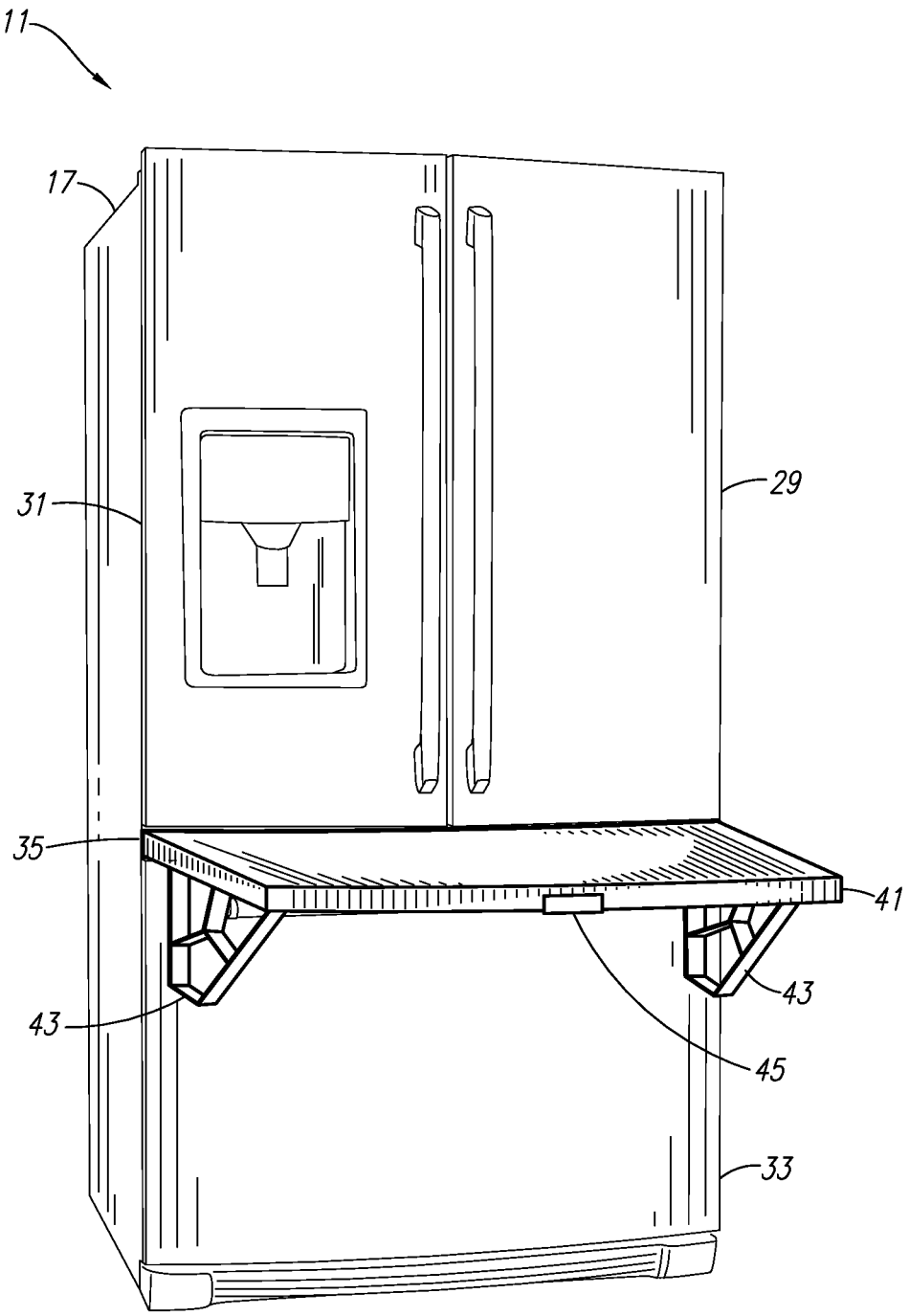
FIG. 3 is a perspective view of a refrigeration appliance.
Figure 4:
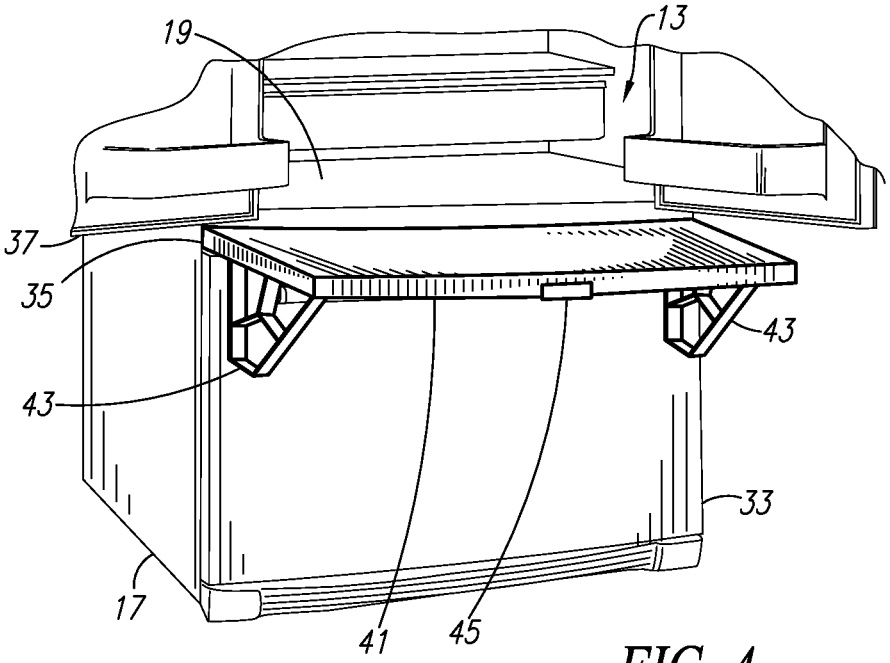
FIG. 4 is a partial perspective view of a refrigeration appliance.

The present invention relates to shelves for a domestic appliance, in particular a refrigeration appliance, such as a refrigerator. The present invention will now be described with reference to the drawings, wherein like reference numerals are used to refer to like elements throughout. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

FIGS. 1-5 show a refrigerator 11. The refrigerator 11 includes an upper interior storage chamber and a lower interior storage chamber for storing food items within the refrigerator. The upper interior storage chamber can be a fresh food storage chamber 13, and the lower interior storage chamber can be a freezer storage chamber 15. The freezer storage chamber 15 is located beneath the fresh food storage chamber 13. Thus, the refrigerator 11 is a "bottom-mount" refrigerator/freezer. Alternatively, the refrigerator could be a "top-mount" refrigerator/freezer with the freezer storage chamber located above fresh food storage chamber.

The refrigerator 11 has an outer appliance housing 17 and one or more inner liners 19. In FIG. 1, the one or more inner liners 19 partially encloses and defines the fresh food storage chamber 13 and the freezer storage chamber 15. The liner 19 provides a rear wall 23, a first sidewall 25 and a second sidewall (opposite the first sidewall) for the storage chambers 13, 15. Foamed-in insulation (not shown) is located between the appliance housing 17 and the inner liner 19. A refrigeration circuit (not shown) cools the storage chambers 13, 15.

The refrigerator 11 includes upper movable closures (e.g., hinged doors 29, 31) for providing access to the fresh food storage chamber 13. The hinged doors are movable between an open position providing access to the fresh food storage chamber 13 (see FIG. 2) and a closed position closing the fresh food storage chamber (see FIGS. 1 and 3). The doors 29, 31 close and seal the fresh food storage chamber 13 when in the closed position. In the example embodiment shown in the figures, the upper movable closures are configured as French doors. Each of the French doors 29, 31 is hinged at a respective lateral side of the appliance housing 17. Upper hinges 30, 32 can be seen in FIG. 2, and the refrigerator would typically include a lower set of hinges (not shown). In other embodiments, the refrigerator can include a single hinged door for closing the fresh food storage chamber 13.

The refrigerator includes a lower movable closure for providing access to the freezer storage chamber 15. The lower movable closure could be a hinged door, or the lower movable closure could part of a pull-out drawer 33 as shown in the figures. The pull-out drawer 33 is movable between an open position providing access to the freezer storage chamber 15 (see FIG. 2) and a closed position closing the freezer storage chamber (see FIGS. 1 and 3). The pull-out drawer 33 can include an attached storage basket for holding food items.

The liner 19 includes a central or horizontal mullion 35 that separates the fresh food 13 and freezer 15 storage chambers. Door gaskets 37 on the inner surfaces of the hinged doors 29, 31 and the drawer 33 seal against the mullion 35 when in their respective closed positions.

Figure 5:
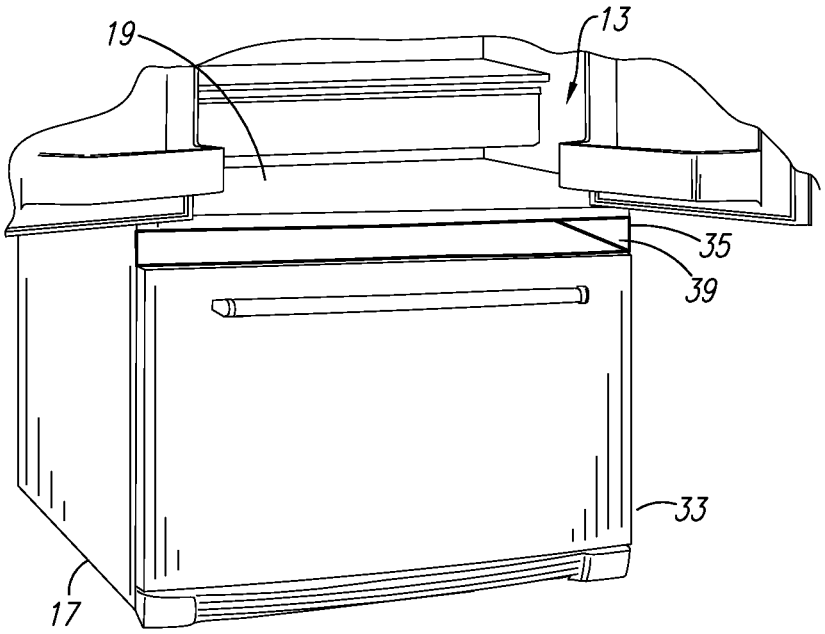
FIG. 5 is a partial perspective view of a refrigeration appliance.

The mullion 35 has a recess or storage pocket 39 that accommodates a deployable shelf 41. The pocket 39 with the shelf removed is shown in FIG. 5. The shelf 41 can be stored within the pocket 39 when not in use, and can be withdrawn from the pocket as needed. For example, while placing food items into the refrigerator 11 or preparing food items removed from the refrigerator, the shelf 41 can be used as a work surface, workstation or staging area for temporarily holding food items until it is desired to return them to the fresh food or freezer storage chamber. In certain embodiments, the shelf 41 can serve as a cutting board and can be made of a suitably thick and/or formed material.

The refrigerator 11 is configured such that the shelf 41 is deployable while the doors 29, 31 and drawer 33 are in their respective open or closed positions. Thus, the mullion 35 is vertically tall enough to accommodate the shelf 41 and also provide sealing surfaces for the gaskets 37 on the doors 29, 31 and the drawer 33. The sealing surfaces for the gaskets 37 can be located on the mullion 35 above and below the pocket 39. Because the shelf 41 can be withdrawn from the storage pocket 39 and deployed while the doors 29, 31 and drawer 33 are in their closed position, the shelf can be used for long periods of time without causing a rise in temperature in either the fresh food storage chamber 13 or the freezer storage chamber 15.

The shelf 41 can include one or more deployable legs 43 for supporting the shelf against the front surface of the refrigerator, in particular against the drawer 33, when the shelf is withdrawn from the storage pocket 39. The legs 43 can be hinged to swing downward from the underside of the shelf 41 when the shelf is withdrawn from the pocket 39. The shelf 41 can include a manual release handle 45 for operating a latch to release the legs 43 and allow the legs to drop downward from the underside of the shel.

Figure 6:
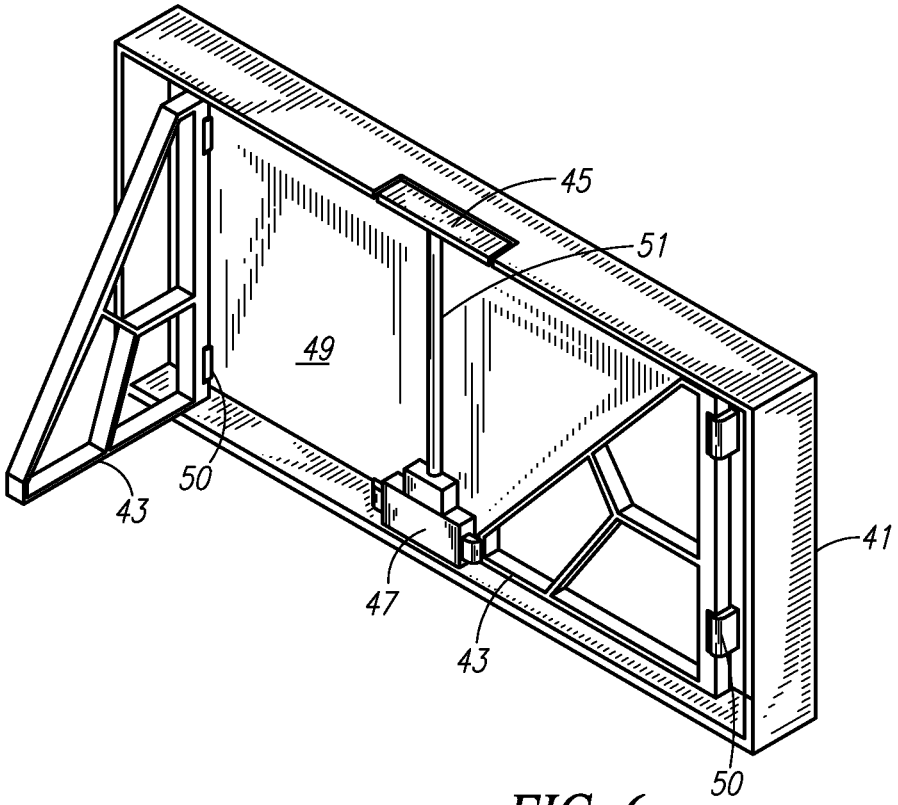
FIG. 6 is a perspective view of a shelf for the refrigeration appliance.

The shelf 41 and latch 47 are shown in further detail in FIG. 6, in which the underside 49 of the shelf is visible. The shelf 41 can be configured as an inverted tray having a perimeter edge that extends downward from the generally horizontal upper surface of the shelf. The legs 43 are hingedly connected to the shelf 41 via hinges 50, and can be folded upward against the underside 49 of the shelf 41 and captured by the latch 47 when not in use. Thus, the legs 43 can be stored within the inverted tray when not in use. The release handle 45 is operatively connected to the latch 47, such as via a rod 51, to operate the latch when the release handle is pushed and/or pulled, to thereby release the captive legs 43. In certain embodiments, the shelf 41 can include a spring return for the legs 43, to bias the legs upward and cause the legs to return to the underside 49 of the shelf when no load is applied to the legs (e.g., when the front of the shelf is lifted upward, pivoting the legs away from the drawer 33). The spring return can be included in one or more of the hinges 50.

In certain embodiments, the pocket in the mullion and/or the shelf can include tracks or drawer slides to facilitate movement of the shelf between the deployed and stored positions. If the pocket and/or shelf include tracks or drawer slides, the shelf can include legs as described above, or the legs can be eliminated if desired. The pocket and/or shelf can further include stops to prevent the inadvertent complete removal of the shelf from the pocket.

Figure 7:
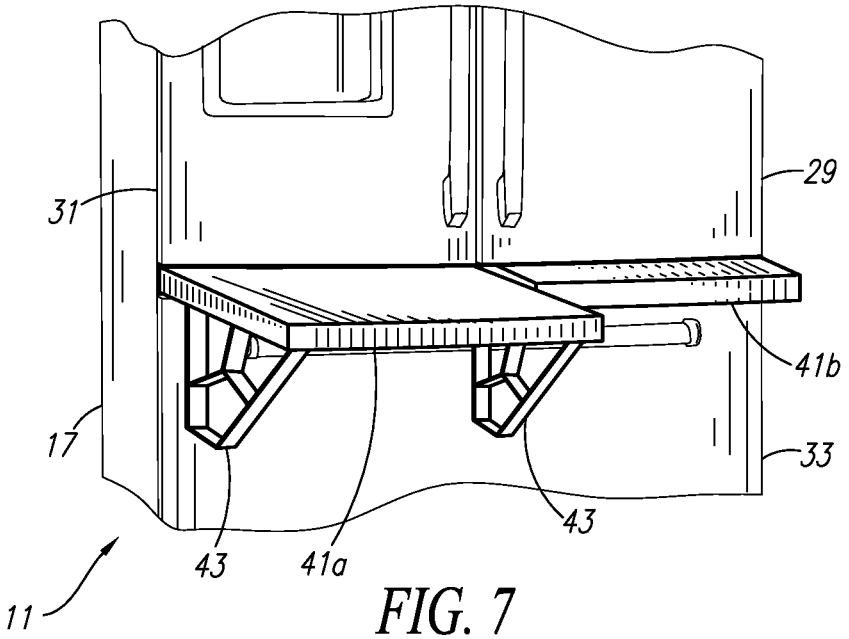
FIG. 7 is a partial perspective view of a refrigeration appliance.

In FIGS. 1-5, the shelf 41 extends across substantially the entire length of the mullion 35 and is about as wide as the refrigerator itself. Thus, the shelf 41 can be about as wide as the drawer 33 and about as wide and both doors 29, 31 together. However, if desired, the shelf can be configured to extend across a smaller portion of the mullion, such as beneath only one of the doors 29, 31, for example. The refrigerator 11 can also include a plurality of shelves that are separately deployable, as shown in FIG. 7. The refrigerator 11 in FIG. 7 has two half-width shelves 41*a*, 41*b* that are separately deployable. The shelves 41*a*, 41*b* can be withdrawn one at a time or simultaneously. Each shelf 41*a*, 41*b* can be located beneath one of the hinged doors 29, 31 and can be about as wide a hinged door. The mullion can have a separate pocket for each shelf 41*a*, 41*b*, or a common pocket for storing both shelves. The use of separately deployable shelves 41*a*, 41*b* can allow a user to approach the refrigerator closely while a shelf is in use, to provide better access to the fresh food storage chamber 13.

Figure 8:
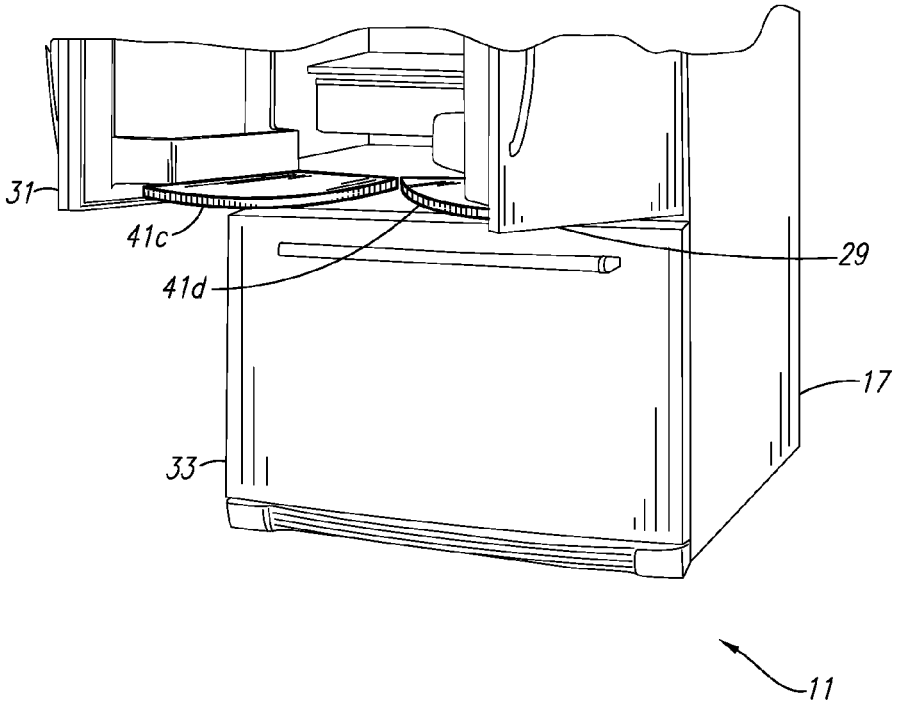
FIG. 8 is a partial perspective view of a refrigeration appliance.

A further example embodiment of a refrigerator 11 having separately deployable shelves is shown in FIG. 8. The shelves 41*c*, 41*d* in FIG. 8 are quadrant-shaped. In certain embodiments, the quadrant-shaped shelves 41*c*, 41*d* can be deployed while the doors 29, 31 and drawer 33 are in the closed position. Alternatively, the quadrant-shaped shelves 41*c*, 41*d* can be respectively attached to the doors 31, 29 so that the shelves are deployed when the doors are opened. If the shelves 41*c*, 41*d* are attached to the doors 31, 29, the pocket for the shelves can be located high on the mullion, so that the lower edges of the doors extend past the pocket. The mullion sealing surfaces for the gaskets on the doors 29, 31 can be located either above the pocket or below the pocket.

The deployable shelves described herein could be incorporated into appliances other than refrigerators. For example, the shelves could be incorporated into combination appliances such as a combination washer and dryer.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigeration appliance, comprising:

an appliance housing;

a liner within the appliance housing and providing an upper interior storage chamber and a lower interior storage chamber separated by a mullion;

an upper movable closure movable between an open position providing access to the upper interior storage chamber, and a closed position closing the upper interior storage chamber; and a lower movable closure movable between an open position providing access to the lower interior storage chamber, and a closed position closing the lower interior storage chamber, wherein the mullion forms a storage pocket, and the refrigeration appliance further comprises a deployable shelf configured to be withdrawn from the storage pocket in the mullion, wherein the deployable shelf comprises at least one deployable leg for supporting the shelf when withdrawn from the storage pocket, and wherein the deployable shelf is configured as an inverted tray having a perimeter edge that extends downward from an upper surface of the shelf, and the at least one deployable leg is hingedly connected to the deployable shelf for storage within the inverted tray.

2. The refrigeration appliance of claim 1, wherein the deployable shelf is configured to be withdrawn from the storage pocket in the mullion while the upper movable closure and the lower movable closure are in their respective closed positions.

3. The refrigeration appliance of claim 1, wherein the deployable shelf is a first deployable shelf, the refrigeration appliance further comprising a second deployable shelf.

4. The refrigeration appliance of claim 3, wherein the upper movable closure comprises a first hinged door hinged at a first lateral side of the appliance housing and a second hinged door hinged at a second lateral side of the appliance housing, and the first deployable shelf is located beneath the first hinged door and the second deployable shelf is located beneath the second hinged door.

5. The refrigeration appliance of claim 3, wherein the first deployable shelf and the second deployable shelf are configured to be separately withdrawn from the storage pocket.

6. The refrigeration appliance of claim 1, wherein the mullion is formed by the liner.

7. The refrigeration appliance of claim 1, wherein the lower interior storage chamber is a freezer storage chamber, and the lower movable closure forms part of a pull-out drawer for storing food items within the freezer storage chamber.

8. The refrigeration appliance of claim 1, further comprising a latch for capturing the at least one deployable leg within the inverted tray.

9. The refrigeration appliance of claim 8, further comprising a manual release operably connected to the latch for releasing the at least deployable leg from the latch.

10. The refrigeration appliance of claim 1, wherein the deployable shelf is quadrant-shaped.

11. A refrigeration appliance, comprising:

an appliance housing;

at least one liner within the appliance housing and providing an upper fresh food storage chamber and a lower freezer storage chamber, wherein the fresh food storage chamber and the freezer storage chamber are separated by a mullion;

an upper door movable between an open position providing access to the fresh food storage chamber, and a closed position closing the fresh food storage chamber; and a lower drawer movable between an open position providing access to the freezer storage chamber, and a closed position closing the freezer storage chamber, wherein the mullion forms a storage pocket between the upper door and the lower drawer, and the refrigeration appliance further comprises a deployable shelf configured to be withdrawn from the storage pocket in the mullion while the upper door and the lower drawer are in their respective closed positions, wherein the deployable shelf comprises at least one deployable leg for supporting the shelf when withdrawn from the storage pocket, and wherein the deployable shelf is configured as an inverted tray having a perimeter edge that extends downward from an upper surface of the shelf, and the at least one deployable leg is hingedly connected to the deployable shelf for storage within the inverted tray.

12. The refrigeration appliance of claim 11, wherein the deployable shelf is a first deployable shelf, the refrigeration appliance further comprising a second deployable shelf.

13. The refrigeration appliance of claim 12, wherein the upper door comprises a first hinged door hinged at a first lateral side of the appliance housing and a second hinged door hinged at a second lateral side of the appliance housing, and the first deployable shelf is located beneath the first hinged door and the second deployable shelf is located beneath the second hinged door.

14. The refrigeration appliance of claim 12, wherein the first deployable shelf and the second deployable shelf are configured to be separately withdrawn from the storage pocket.

15. The refrigeration appliance of claim 11, further comprising a latch for capturing the at least one deployable leg within the inverted tray.

16. The refrigeration appliance of claim 15, further comprising a manual release operably connected to the latch for releasing the at least deployable leg from the latch.

* * * * *